United States Patent [19]

Blake

[11] Patent Number: 4,740,873

[45] Date of Patent: Apr. 26, 1988

[54] ENERGY SAVING "U" SHAPED FLUORESCENT LAMP

[75] Inventor: Norman A. Blake, Andover, Mass.

[73] Assignee: GTE Products Corporation, Danvers, Mass.

[21] Appl. No.: 83,917

[22]. Filed: Aug. 7, 1987

Related U.S. Application Data

[63] Continuation of Ser. No. 303,272, Sep. 17, 1981, abandoned.

[51] Int. Cl.[4] ..... F21S 5/00

[52] U.S. Cl. ..... 362/216; 362/221; 315/53; 315/97

[58] Field of Search ..... 362/216, 221; 315/53, 315/97

[56] References Cited

U.S. PATENT DOCUMENTS

| | | | |
|---|---|---|---|
| 3,602,755 | 8/1971 | Hoen | 362/216 |
| 3,634,681 | 1/1972 | Johnson | 362/216 |
| 3,954,316 | 5/1976 | Luchetta | 315/96 |
| 4,082,981 | 4/1978 | Morton | 315/DIG. 5 |
| 4,135,115 | 1/1979 | Abernethy | 315/97 |
| 4,163,176 | 7/1979 | Cohen | 315/58 |

FOREIGN PATENT DOCUMENTS

| | | | |
|---|---|---|---|
| 0037980 | 3/1981 | European Pat. Off. | 362/216 |

*Primary Examiner*—Donald P. Walsh

*Attorney, Agent, or Firm*—Carlo S. Bessone; William H. McNeill

[57] ABSTRACT

A "U" shaped fluorescent lamp includes a housing extending the legs of the lamp, the housing containing means to reduce current flow in the lamp, thereby saving energy.

5 Claims, 2 Drawing Sheets

ENERGY SAVING "U" SHAPED FLUORESCENT LAMP

This application is a continuation of application Ser. No. 303,272, filed Sept. 17, 1981, now abandoned.

TECHNICAL FIELD

This invention relates to fluorescent lamps and more particularly to energy saving lamps formed in the shape of a "U".

BACKGROUND ART

In view of the increasing costs of energy a demand has arisen for lighting sources which use less power. In many areas, simply replacing incandescent light sources with fluorescent tubes can accomplish this result. However, in those places already employing fluorescent tubes, there still remains a need to reduce energy consumption. This can sometimes be accomplished by removing some of the overhead lamps or by removing one lamp of a series pair and replacing it with a dummy lamp containing a capacitor. Such techniques usually affect the lighting distribution.

Another method which has been employed involves detaching some of the wires between a fluorescent lamp ballast and the lamp, and then connecting in the circuit a transformer-capacitor combination, as disclosed in U.S. Pat. No. 3,954,316. This technique, of course, involves rewiring.

Still another approach, used with elongated fluorescent tubes, is to employ a lamp which is shorter than the distance between the socket in which the lamp is mounted. This distance is made up by attaching to one end of the lamp an extension base which contains power reducing circuitry. Such a device is shown in U.S. Pat. No. 4,163,176 and has enjoyed much success; however, the dark space at the end of the lamp is noticeable and occasionally objectionable. Also, the pressure of the starting gas in the shorter tube is increased over that of the standard bulb it replaces.

Further, there has been no reasonable way to apply these energy saving ideas to other configurations of fluorescent lamps.

DISCLOSURE OF INVENTION

It is, therefore, an object of this invention to obviate the disadvantages of the prior art.

It is another object of the invention to enhance the energy saving potential of fluorescent bulbs having a configuration other than elongated.

These objects are accomplished, in one aspect of the invention, by the provision of a "U" shaped lamp which includes a housing extending between and affixed to the legs of the lamp. The housing contains means for reducing current flow in the lamp. Utilizing this approach, no changes are necessary in the lamp construction itself. The lamp easily retrofits into existing sockets and no dark space exists in the fixture.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
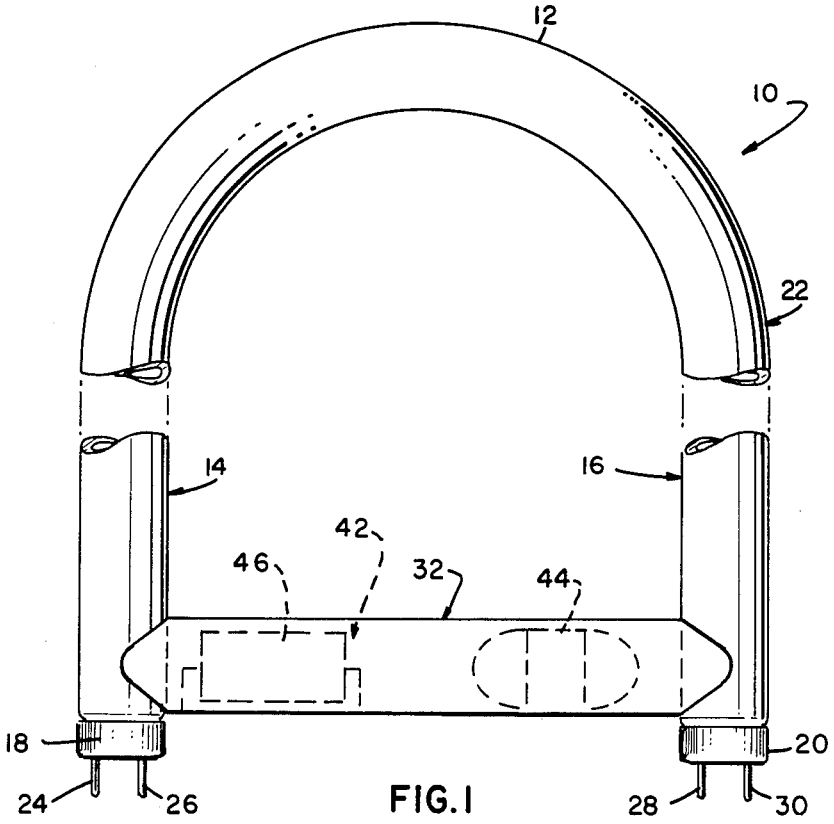
FIG. 1 is an elevational view of a "U" shaped fluorescent lamp embodying the invention.
Figure 2:
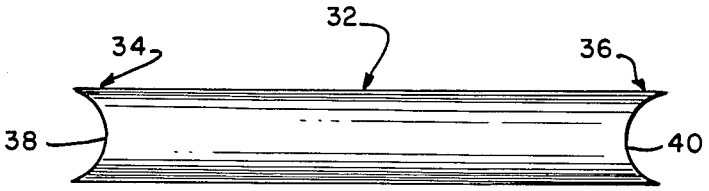
FIG. 2 is a top view of the housing of the invention.
Figure 3:
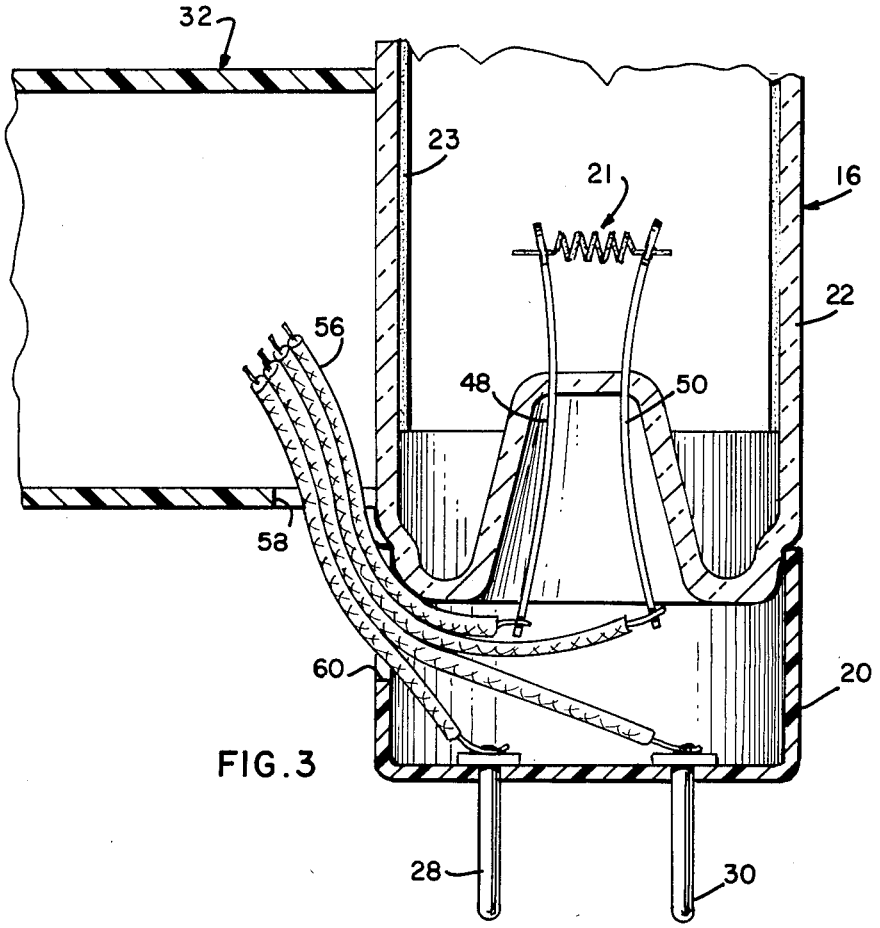
FIG. 3 is an enlarged, partial, sectional view of one embodiment for making the appropriate electrical connections to employ the invention.

Referring now to the drawings with greater particularity, there is shown in FIG. 1 a fluorescent lamp 10 of "U" shaped configuration having a bight 12 and legs 14 and 16 which lie in substantially the same plane. The legs terminate in bases 18 and 20. Lamp 10 is conventional in construction and has the usual electrodes 21 (one of which is shown in FIG. 3) sealed in the ends thereof; has a phosphor coating 23 on the interior surface of its glass envelope 22; and contains within envelope 22 an arc generating and sustaining medium which includes mercury. Pins 24 and 26 project from base 18 and pins 28 and 30 project from base 20. Bases 18 and 20 are preferably formed from an electrically insulating material, such as plastic; however, the bases can be constructed of metal provided the projecting pins are electrically insulated therefrom.

A housing 32 spans the distance between legs 14 and 16 at a position just above the bases 18 and 20. Housing 32 can be cylindrical and preferably has a maximum length substantially equal to the center to center distance between legs 14 and 16. The ends 34 and 36 of housing 32 are notched as at 38 and 40 to match the configuration of the legs 14 and 16 and mate therewith. A suitable bonding cement or epoxy is applied to these notched ends to affix the housing 32 to the legs 14 and 16. Housing 32 forms an integral part of lamp 10.

Figure 4:
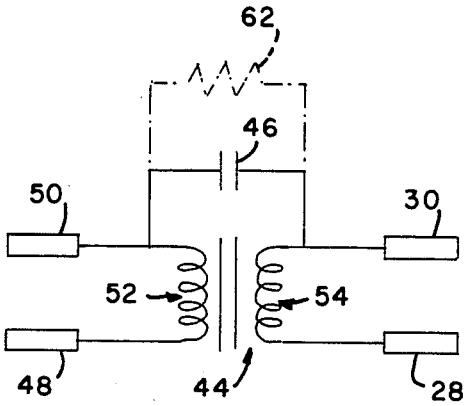
FIG. 4 is a circuit diagram of one form of energy saving circuitry that can be used with the invention.

Current reducing means 42 is contained within housing 32 and can comprise a transformer 44 and a capacitor 46. Capacitor 46 creates an impedance which reduces current flow through lamp 10 while consuming very little power; and transformer 44 maintains the proper electrode heater current through proximate electrode 21. The electrode lead-in wires 48 and 50 (see FIGS. 3 and 4) are connected to the secondary 52 of transformer 44 and the projecting base pins 28 and 30 are connected to the primary 54 of transformer 44. The capacitor 46 is connected across transformer 44; that is to say one side of capacitor 46 is connected to the primary 54 of transformer 44 and the other side to secondary 52. This places capacitor 46 in series with lamp 10.

FIG. 3 illustrates generally how the physical connections of the elements of current reducing means 42 can be applied to the appropriate electrical connections, e.g., by wires 56 fed through a suitable opening 58 in housing 32 and through an opening 60 in base 20.

When this invention is employed with instant start fluorescent lamps, the transformer 44 is omitted from housing 32 since separate heater current is not provided for the electrodes of such lamps.

If desired, a bleeder resistor 62 (see FIG. 4) can be placed of capacitor across capacitor 46 in order to bleed the charge off capacitor 46 when the lamp is turned off. It may also be desirable to to place a thermal breaker in series with capacitor 46 in order to protect the capacitor at the end of life.

There is thus provided an energy saving lamp having a configuration other than elongated. The concept does not require rewiring of existing ballasts, nor does it required that the lamp be shortened to accommodate the requisite circuitry. Further, in use, the lamp presents a pleasing appearance with an even light distribution throughout the fixture with which it is employed.

Assembly of the new lamp is simple and economical and begins with a standard "U" shaped lamp without bases attached. The components making up the current reducing means 42 are inserted into housing 32. Next, the electrical connections are made to the lamp lead-in 48 and 50 and the base pins 28 and 30 (one end only), and then housing 32 is positioned between the legs 14 and 16 and cemented into place. Bases 18 and 20 are cemented, or otherwise affixed, to complete the lamp.

While there have been shown and described what are at present considered to be the preferred embodiments of the invention, it will be apparent to those skilled in the art that various changes and modifications can be made herein without departing from the scope of the invention as defined by the appended claims.

INDUSTRIAL APPLICABILITY

Lamps employing the invention described above are intended to reduce energy consumption and energy costs installations where lower lighting levels can be tolerated. Such installations can include office areas now overlighted; non-task areas of offices; lobbies and waiting rooms; corridors; entrance ways and elevators; and storage areas and non-merchandizing areas of retail stores.

Magnitude of energy reduction can be selected by choosing a capacitor of electrical size consistent with the amount of current and power reduction desired. Lamps have been made with wattage reductions of 33% and 50%. This lamp is to be used with one standard lamp.

I claim:

1. A "U" shaped fluorescent lamp for use in a fixture, said fluorescent lamp comprising:

a pair of legs lying substantially in the same plane;

a base affixed to each of said legs;

a housing extending between said legs and affixed thereto, said housing forming an integral part of said fluorescent lamp; and means contained within said housing for reducing current flow in said fluorescent lamp.

2. The "U" shaped fluorescent lamp of claim 1 wherein said housing is affixed to said legs of said fluorescent lamp at a position above said bases.

3. The "U" shaped fluorescent lamp of claim 2 wherein said housing is substantially cylindrical in shape.

4. The "U" shaped fluorescent lamp of claim 3 wherein the ends of said housing are notched to conform to the shape of said legs.

5. The "U" shaped fluorescent lamp of claim 4 wherein the longest dimension of said housing is substantially equal to the center to center distance between said legs.

* * * * *